US012565730B2

(12) United States Patent
Pelczer et al.

(10) Patent No.: US 12,565,730 B2
(45) Date of Patent: Mar. 3, 2026

(54) DAMPER, IN PARTICULAR FRICTION DAMPER

(71) Applicant: SUSPA GmbH, Altdorf (DE)

(72) Inventors: Andreas Pelczer, Altdorf (DE); Marco Mayer, Sulzbach-Rosenberg (DE); Sebastian Ertl, Edelsfeld (DE); Michael Weder, Nuremberg (DE)

(73) Assignee: SUSPA GMBH, Altdorf (DE)

( * ) Notice: Subject to any disclaimer, the term of this patent is extended or adjusted under 35 U.S.C. 154(b) by 384 days.

(21) Appl. No.: 18/177,861

(22) Filed: Mar. 3, 2023

(65) Prior Publication Data

US 2023/0295859 A1 Sep. 21, 2023

(30) Foreign Application Priority Data

Mar. 17, 2022 (DE) ..... 10 2022 202 661.6

(51) Int. Cl.
*D06F 37/20* (2006.01)

(52) U.S. Cl.
CPC ..... *D06F 37/20* (2013.01)

(58) Field of Classification Search
CPC ..... F16F 2222/04; F16F 7/08; F16F 7/095
USPC ..... 188/381
See application file for complete search history.

(56) References Cited

U.S. PATENT DOCUMENTS 4,462,578 A * 7/1984 Camilleri ..... F16F 13/02 267/209
4,515,845 A * 5/1985 Annis ..... F16F 7/00 428/95
4,674,729 A * 6/1987 Wallace ..... F16F 7/08 29/446
5,085,297 A * 2/1992 Bauer ..... F16F 7/09 188/129
5,133,435 A * 7/1992 Taylor ..... F16F 7/09 188/129
7,861,833 B2 * 1/2011 Park ..... F16F 7/09 188/266
8,348,028 B2 * 1/2013 Zimmer ..... F16F 9/368 188/134
8,640,837 B2 * 2/2014 Peuker ..... F16F 7/08 267/196
10,544,847 B2 * 1/2020 Bauer ..... F16F 13/005
10,619,692 B2 * 4/2020 Tomita ..... F16J 10/04
2002/0170794 A1 * 11/2002 Dubach ..... F16F 9/0209 267/196
2005/0263668 A1 * 12/2005 Thigpen ..... E21B 47/01 248/560

(Continued)

FOREIGN PATENT DOCUMENTS

BE 529829 A 7/1954
CN 116771837 A * 9/2023 ..... D06F 37/20

(Continued)

*Primary Examiner* — Robert A. Siconolfi
(74) *Attorney, Agent, or Firm* — McGlew and Tuttle, P.C.

(57) ABSTRACT

A damper, in particular for washing machines having a spin cycle, includes a housing having a central longitudinal axis and at least partially enclosing a housing inner space by housing walls, a tappet which can be displaced in the housing along the central longitudinal axis and is guided out of the housing, fastening members which are arranged at free ends of the housing and of the tappet, and at least one compensation member for compensating a play between the housing walls and the tappet.

23 Claims, 10 Drawing Sheets

(56) References Cited

U.S. PATENT DOCUMENTS

| | | | | |
|---|---|---|---|---|
| 2006/0231363 | A1* | 10/2006 | Chiba | F16F 7/02 188/381 |
| 2007/0017260 | A1* | 1/2007 | Dillmann | F16F 7/09 68/23.1 |
| 2007/0278727 | A1* | 12/2007 | Peuker | F16F 7/08 267/196 |
| 2010/0252382 | A1* | 10/2010 | Dillmann | D06F 37/20 29/592 |
| 2013/0206525 | A1* | 8/2013 | Ogata | F16F 7/08 188/381 |
| 2017/0002886 | A1* | 1/2017 | Tomita | F16F 9/0218 |
| 2018/0163808 | A1* | 6/2018 | Bauer | F16F 7/095 |
| 2018/0363254 | A1* | 12/2018 | Cho | E01D 19/041 |
| 2019/0170210 | A1* | 6/2019 | Ohji | B62D 27/04 |

FOREIGN PATENT DOCUMENTS

| | | | | | |
|---|---|---|---|---|---|
| DE | 1625448 | B1 | | 12/1969 | |
| DE | 2747079 | A1 | | 5/1979 | |
| DE | 3513838 | A1 | * | 10/1986 | D06F 37/20 |
| DE | 3908191 | A1 | * | 9/1990 | F16F 7/09 |
| DE | 3923087 | A1 | * | 1/1991 | D06F 37/20 |
| DE | 4427336 | A1 | * | 2/1996 | F16F 7/09 |
| DE | 102005005177 | A1 | | 9/2005 | |
| DE | 102020211874 | A1 | | 4/2021 | |
| EP | 1862694 | A1 | * | 12/2007 | D06F 37/20 |
| EP | 2634452 | B1 | | 4/2016 | |
| FR | 2406758 | A1 | | 5/1979 | |
| KR | 102526527 | B1 | * | 4/2023 | F16F 15/02 |
| WO | WO-2005007964 | A1 | * | 1/2005 | D06F 37/20 |

* cited by examiner

DAMPER, IN PARTICULAR FRICTION DAMPER

CROSS-REFERENCES TO RELATED APPLICATIONS

This application claims the priority of German Patent Application, Serial No. DE 10 2022 202 661.6, filed Mar. 17, 2022, the content of which is incorporated herein by reference in its entirety as if fully set forth herein.

FIELD OF THE INVENTION

The invention relates to a damper, in particular a friction damper, such as is used in washing machines having a spin cycle.

BACKGROUND OF THE INVENTION

From EP 1 862 694 A1 a friction damper having a housing in which a tappet is arranged in an axially displaced manner is known. A friction lining is held on the tappet, which friction lining rests against opposite housing walls of the housing in a frictional manner. In order for the tappet to be displaced relative to the housing without friction, a clearance is required between the housing walls and the tappet. Due to manufacturing tolerances, excessive play can lead to undesired movement of the tappet in the housing and thus to rattling noises during operation of the damper.

SUMMARY OF THE INVENTION

It is an object of the invention to provide a friction damper having improved acoustic properties.

This object is achieved by a damper, in particular for washing machines having a spin cycle, comprising a housing having a central longitudinal axis and at least partially enclosing a housing inner space by housing walls, a tappet which can be displaced in the housing along the central longitudinal axis and is guided out of the housing, fastening members which are fastened to free ends of the housing and the tappet, comprising at least one compensation member for compensating a play between the housing walls and the tappet. The essence of the invention is that in a damper, in particular a friction damper, a tappet that can be displaced longitudinally in a housing is supported by means of at least one compensation member. In particular, the at least one compensation member is arranged at the tappet and/or the housing, in particular fastened thereto. When the tappet is displaced relative to the housing, the at least one compensation member is also moved. The at least one compensation member serves to compensate for a play between a respective housing wall of the housing and the tappet. The at least one compensation member is in particular flexible, in particular compensating, in particular elastic and/or in particular resilient. The at least one compensation member improves a stable displacement of the tappet along a central longitudinal axis of the housing. The at least one compensation member enables in particular a compensation and in particular a support of the tappet against opposite housing walls.

The at least one compensation member is in particular an elevated structure which projects into an intermediate space defined by the clearance, which intermediate space is bounded between the tappet and one of the housing walls. In particular, the at least one compensation member extends in a direction which is oriented transversely and in particular perpendicularly to a center plane defined by the tappet and containing the central longitudinal axis.

A compensation of the play is in particular given when the original play between the tappet and the housing wall is reduced. Rattling noises are thereby reduced.

A support by the at least one compensation member is given if there is a contact, in particular a permanent contact, between the tappet and the housing wall by the at least one compensation member. Rattling noises are thus essentially excluded.

The at least one compensation member has in particular a flexibility, in particular in the form of a structural flexibility and/or a material flexibility. A structural flexibility is in particular given if the at least one compensation member enables an elastic behavior solely due to its structure, i.e. its geometry. In particular, the at least one compensation member is designed as a thin, in particular web-like structure, wherein the length and/or height of the web-like structure are significantly greater than its thickness and in particular amount to at least 3 times, in particular at least 5 times, in particular at least 10 times and in particular at least 20 times its thickness. A material flexibility is in particular made possible by the fact that the compensation member has a flexible material, in particular in a contact region which serves to rest against the housing wall and/or the tappet. An elastic material is in particular a soft material, in particular a soft plastic, in particular elastomers, in particular vulcanizates of natural rubber and/or silicone rubber, or foamed plastics, i.e. foams, in particular polyurethane foams. The soft plastic has in particular a hardness of at most 90 Shore A, in particular at most 85 Shore A and in particular at most 80 Shore A.

A damper configured such that the at least one compensation member is integrally formed on the tappet enables non-complex manufacturing. In particular, the tappet can be manufactured in one piece from plastic material by injection molding. The at least one compensation member can be integrally molded on as a molded member in the injection molding process. In particular, the at least one compensation member may comprise a separate material and/or be sheathed at least in regions thereof. In particular, the 2-component injection molding process is suitable in this respect.

A damper configured such that the at least one compensation member is arranged at the housing, in particular fastened thereto and in particular integrally formed, enables a stable arrangement of the at least one compensation member, in particular on an inner side of the housing, in particular adjacent to the housing walls that are facing the tappet. Undesirable contamination as a result of gaps on the tappet is avoided. The at least one compensation member on the housing is designed in particular as a spring member, in particular as a resilient surface member in the manner of a leaf spring, in particular made of a metallic material, in particular steel and in particular stainless steel, and/or a plastic material, in particular hard plastic, in particular polyamide (PA), polymethyl methacrylate (PMMA), polypropylene (PP) and/or polycarbonate (PC).

A damper configured such that the at least one compensation member has a compensation member length which extends along the central longitudinal axis ensures a stable compensation of the play along an extension and/or insertion direction of the tappet with respect to the housing. The at least one compensation member extends along the central longitudinal axis over at least 30% of a free length of the tappet, in particular over at least 50% of the free length, in particular over at least 70% of the free length, in particular over at least 80% of the free length, in particular over at least 90% of the free length, in particular over at least 95% of the free length and in particular over the entire free length of the tappet. The term free length is understood to mean in particular a region of the tappet that is free of further functional components.

A damper comprising two compensation members which are in particular oriented in opposite directions with respect to a center plane of the tappet ensures a sturdier arrangement of the tappet in the housing. The support is improved. In particular, at least two compensation members are oriented in opposite directions of the tappet, in particular anti-parallel and in particular perpendicular to the center plane. The risk of rattling noises is additionally reduced. In particular, the compensation members are arranged at the tappet and in particular are formed on opposite tappet surfaces. In particular, the compensation members are mounted on both sides of the tappet and serve to support the tappet against opposite housing walls.

A damper configured such that the at least one compensation member holds the tappet in the housing without play improves the displacement of the tappet. The tappet is reliably supported by the at least one compensation member in a support direction that is oriented transversely and in particular perpendicularly to the central longitudinal axis. Along the support direction, the tappet is arranged with a preload. The preload results from the fact that the tappet with the at least one, in particular the at least two, compensation members extending in the support direction has a thickness which is greater than a clear width of the housing. When the tappet is inserted into the housing, the at least one compensation member is flexibly and in particular elastically pressed in the direction of the tappet. This causes a preload along the support direction.

A compensation member configured such that the at least one compensation member is designed as a lamella, wherein the lamella extends at least in portions transversely to the central longitudinal axis and is designed in particular in a wave-like manner and/or is oriented obliquely has a particularly advantageous structure. It has been found in particular that it is advantageous if the at least one compensation member has a longitudinal extension which is in particular non-linear and in particular transverse to the central longitudinal axis. The at least one compensation member is in particular designed as a lamella which is oriented obliquely with respect to the central longitudinal axis and/or runs in a wave-shaped manner. A lamella of this type has an elevated swept surface, in particular on the housing inner wall. This reduces the wear of the lamella and/or the corresponding contact surface on the housing inner wall. The service life of the damper is increased.

The design of a damper configured such that the housing and/or the tappet is double-T-shaped in cross-section, in particular perpendicular to the central longitudinal axis improves the axial guidance of the tappet along the central longitudinal axis. The double-T-shaped design of the housing and/or tappet is given in a plane that is oriented transversely and in particular perpendicularly to the central longitudinal axis.

A damper configured such that the tappet has an intermediate web defining a center plane, wherein in particular the center plane comprises the central longitudinal axis, enables a stable support in the housing. The tappet in particular has an intermediate web arranged between two side webs, which intermediate web defines a center plane containing the central longitudinal axis. The at least one compensation member extends in particular in a direction transverse and in particular perpendicular to the center plane. In particular, the at least one friction lining rests against a housing inner wall of the housing in a frictional manner. In particular, the at least one friction lining rests against opposite housing walls in a frictional manner. In particular, the housing walls are oriented parallel to each other. In particular, exactly one friction lining is arranged in one friction lining recess in each case.

In addition or alternatively, the at least one friction lining can also be in frictional contact with a friction insert. In this case, the friction lining is not in direct contact with the housing wall. It is also conceivable that the at least one friction lining rests against the housing wall with one friction surface and against a friction insert with a further friction surface that is arranged in an opposite position to the other friction surface. It is also conceivable that a friction lining extends only partially along the longitudinal axis of the housing so that, in the event of an axial displacement of the tappet, the friction lining is first in frictional contact with the friction insert and then with the housing wall or vice versa.

A damper configured such that the tappet has at least one friction lining recess which in particular completely penetrates the tappet, wherein in particular the at least one friction lining recess has a rectangular or diamond-shaped form, enables advantageous use of a friction lining on the tappet. For this purpose, at least one friction lining recess is arranged on the tappet as a functional component.

A damper configured such that the friction lining recess is bounded by end sides located at the axial ends and longitudinal sides connecting the latter, wherein in particular at least one end side is designed to be serrated, is designed to be compact and efficient.

A damper comprising at least one friction lining, which is arranged in particular in the at least one friction lining recess and rests in a frictional manner against at least one housing wall, wherein in particular the shape of the friction lining is adapted to the shape of a friction lining recess, wherein in particular the friction lining recess is designed to be serrated on at least one end side, enables a passive friction effect. The intermediate web is in particular designed in a strip-like or plate-like manner. The intermediate web may have a rectangular shape. The intermediate web is designed to be flat and in particular planar.

A damper configured such that the housing has a housing body which is in particular made in one piece is of non-complex design. A housing body can in particular be manufactured in one piece in a cost-efficient manner by plastic injection molding.

A damper configured such that at least one friction insert is arranged on the inside of the housing, which friction insert in particular forms the at least one compensation member, enables improved frictional conditions by the at least one friction lining resting against a friction insert provided for this purpose on the inner side of the housing in a frictional manner. In a particularly advantageous embodiment, the friction insert can additionally assume the function of the at least one compensation member. This means that the at least one compensation member and the at least one friction insert are implemented by one and the same component. A damper of this type has increased functional integration.

Both the features indicated in the patent claims and the features indicated in the embodiments of dampers according to the invention are each suitable, either on their own or in combination with each other, for further forming the subject matter according to the invention. The respective combinations of features do not constitute any restriction with regard to the further configurations of the subject matter of the invention, but are essentially merely exemplary in character.

Further features, advantages and details of the invention will be apparent from the following description of embodiments based on the drawing.

DESCRIPTION OF THE PREFERRED EMBODIMENTS

Figure 1:
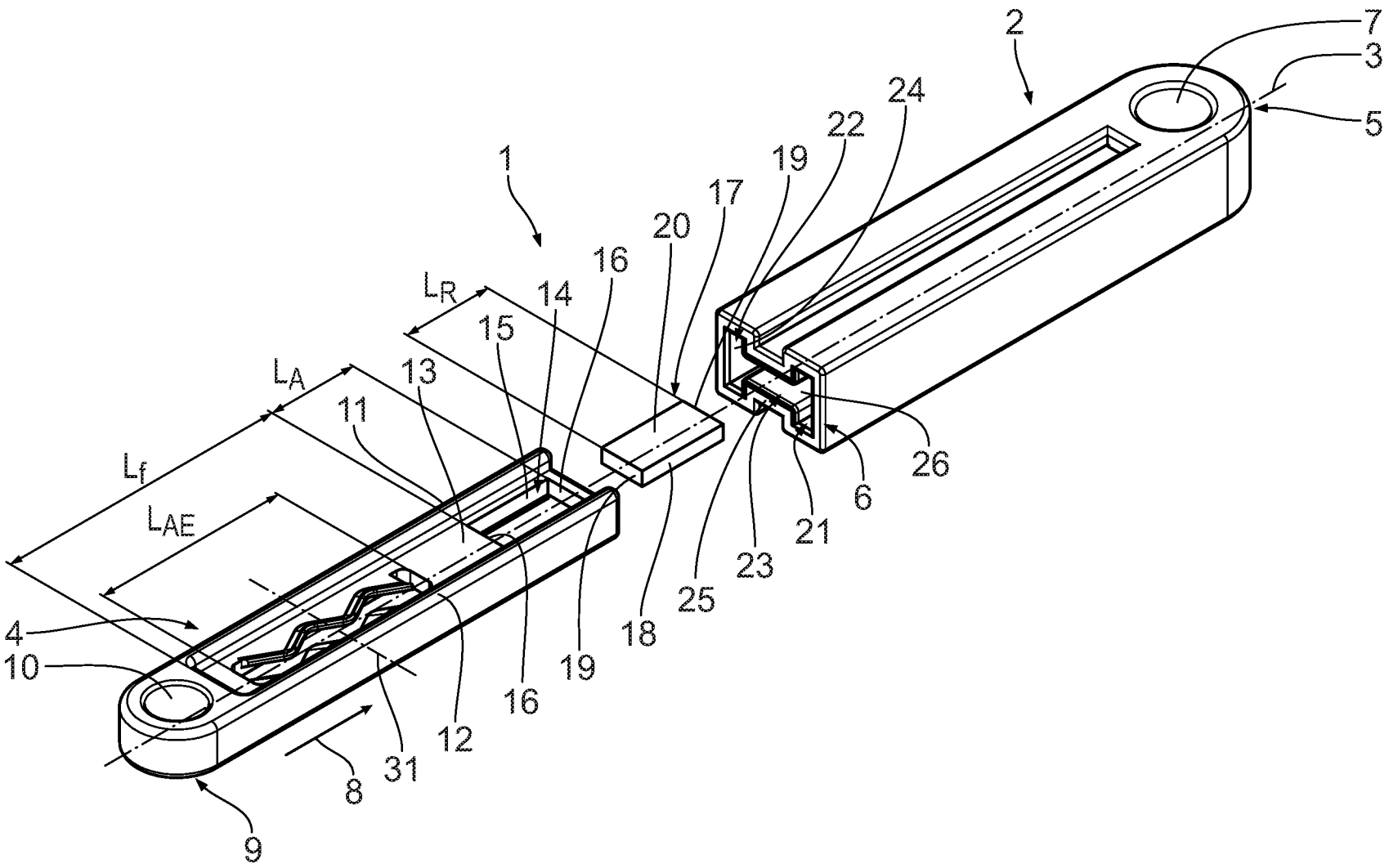
FIG. 1 shows a perspective exploded illustration of a damper according to a first embodiment including compensation members on the tappet as wave-shaped lamellae.
Figure 2:
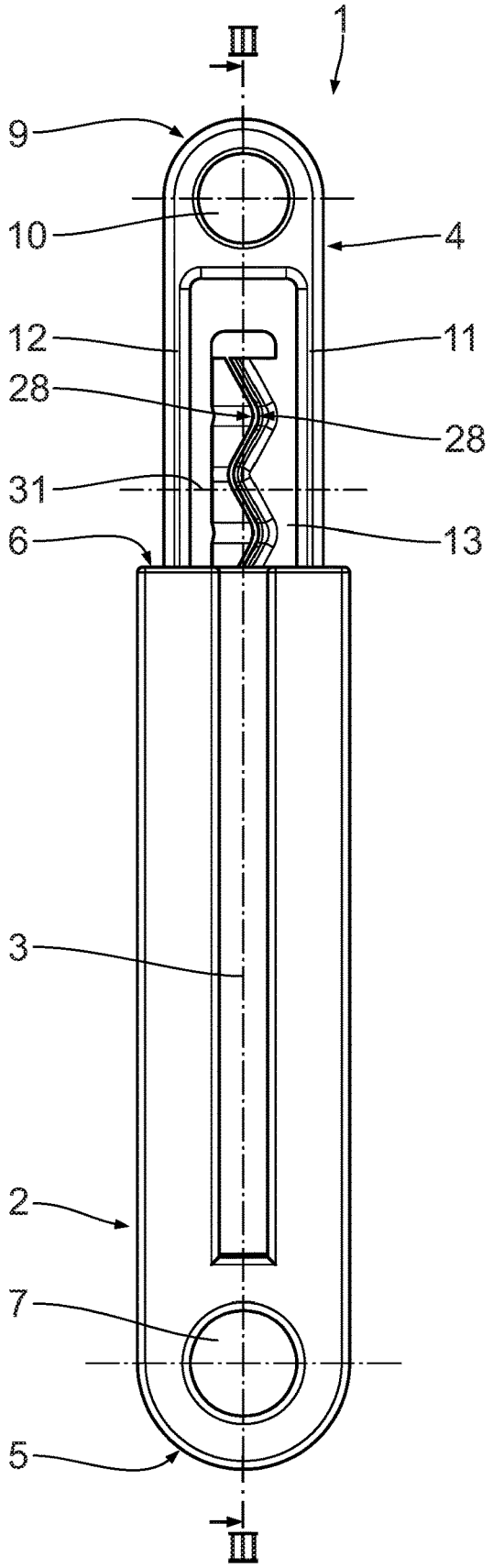
FIG. 2 shows a top view onto the damper according to FIG. 1 with the tappet partially inserted into the housing.
Figure 3:
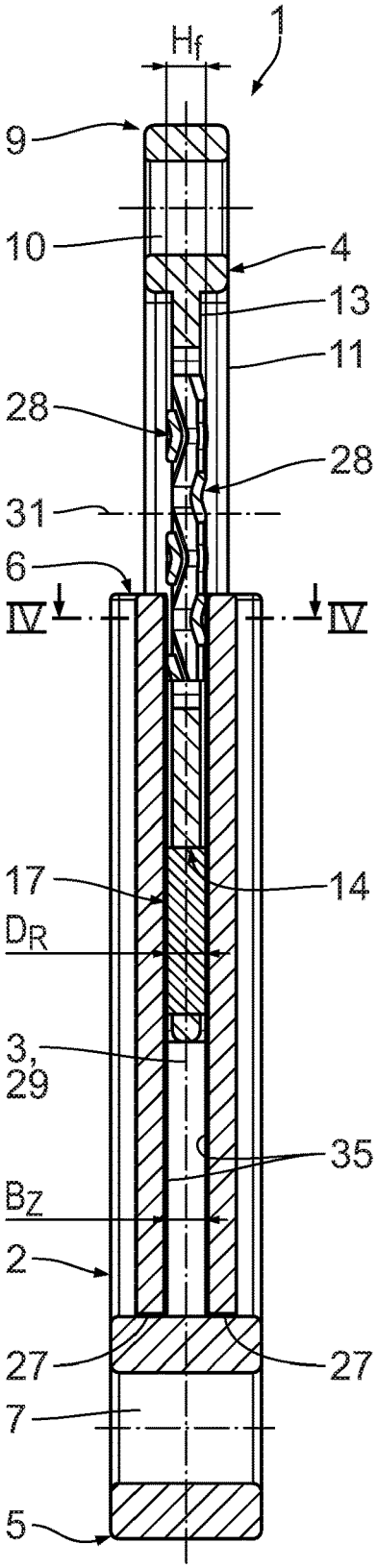
FIG. 3 shows a sectional illustration according to section line III-III in FIG. 2.
Figure 4:
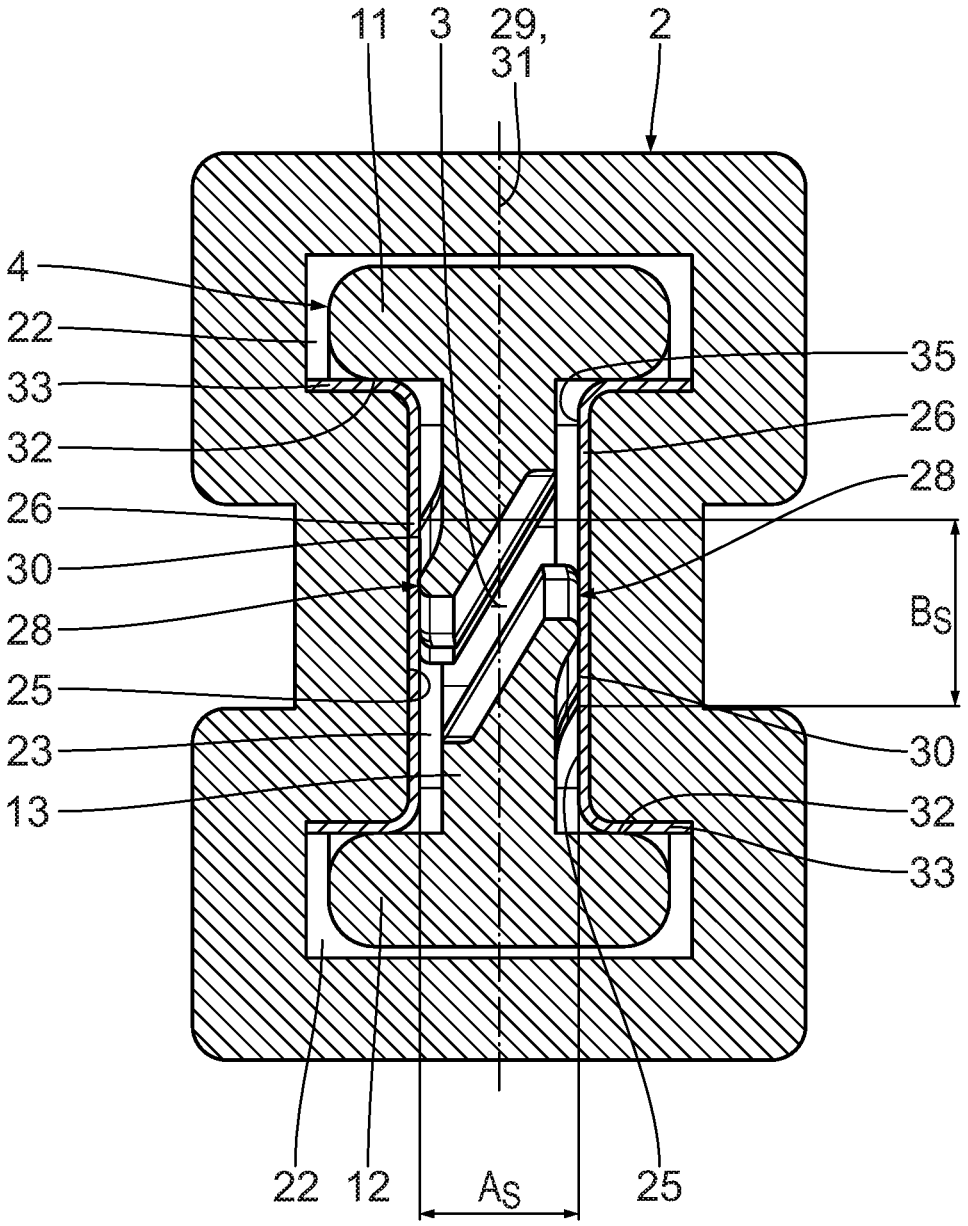
FIG. 4 shows an enlarged sectional representation according to section line IV-IV in FIG. 3.

In the following, a first embodiment of the invention is described with reference to FIGS. 1 to 4. A damper 1 has a housing 2 with a central longitudinal axis 3, in which a tappet 4 is guided in a displaceable manner. The housing 2 is formed in one piece. It is also possible to provide the housing 2 composed of several parts, in particular two parts. The housing 2 has an outer, axial end 5 and an opposite end 6 that faces the tappet 4. In the region of the end 5, the housing 2 has a fastening member 7, in particular in the form of an eye, via which the housing 2 is fastened and articulated in the washing machine. The tappet 4 can be inserted into the housing 2 along an insertion direction 8 which runs parallel to the central longitudinal axis 3. At the outer end 9 of the tappet 4, which is opposite to the direction 8, the tappet 4 has a fastening member 10 in the form of an eye, via which the tappet 4 is articulated and fastened in a washing machine. The tappet 4 can be prevented from being pulled completely out of the housing 2 by extension limiting means which are not shown.

Starting behind the fastening member 10 in the direction 8, the tappet 4 has a double-T-shaped or H-shaped cross-section, which is formed by two side webs 11, 12, which run parallel to each other, and by an intermediate web 13 arranged between them, which connects the side webs 11, 12 to each other. The intermediate web 13 runs perpendicular to the side webs 11, 12. In the region of the end of the tappet 4 located in the direction 8, a friction lining recess 14 is provided in the intermediate web 13, which completely penetrates the intermediate web 13, i.e. is open to two sides—upward and downward. The recess 14 is bounded on all sides by the intermediate web 13, i.e. in the plane that is formed by the intermediate web 13. The recess 14 has a rectangular shape including parallel longitudinal sides 15 located along the direction 8 and parallel end sides 16 connecting the longitudinal sides 15. In the recess 14, a friction lining 17 is arranged, the shape of which in the simplest case corresponds essentially to that of the recess 14. The friction lining 17 is thus cuboidal, wherein its end sides 19 rest against the end sides 16 of the recess 14 and its longitudinal sides 18 rest against the longitudinal sides 15 of the recess 14. Otherwise, the friction lining 17 has two friction surfaces 20 that run parallel to each other and form the top and bottom of the cuboid. The friction lining 17 consists, for example, of a suitable foam material. The friction lining 17, which is itself preferably formed in one piece, is located directly on the edge of the recess 14 on the tappet 4, which is preferably formed in one piece.

The housing 2 encloses a housing inner space 21 whose cross-sectional shape corresponds to the outer contour of the tappet 4, i.e. the housing 2 also has a double-T cross-sectional shape. Two longitudinal channels 22 that extend along the central longitudinal axis 3 and correspond to the side webs 11, 12 are formed in the housing 2 and are connected to each other by an intermediate channel 23 that corresponds to the intermediate web 13. The longitudinal channels 22 are defined by longitudinal channel walls 24. The intermediate channel 23 is defined by two opposite intermediate channel walls 25 that run parallel to each other. Planar friction inserts 26 made of sheet metal are fastened to the intermediate channel walls 25. These friction inserts 26 are fixed in the region of transition to the fastening member 10 by L-shaped recesses 27, which are provided in corresponding longitudinal grooves in the intermediate channel wall 25. The friction inserts 26 extend over the full length of the housing inner space 21 and are each located between the intermediate channel walls 25 and the intermediate web 13 of the tappet 4. The housing 2 is advantageously made of plastic. The friction inserts 26 can, for example, be made of sheet steel.

The damper 1 is a friction damper.

Two compensation members 28 are arranged at the tappet 4, in particular at its intermediate web 13. The compensation members 28 are each designed as a wave-shaped lamella. Along the central longitudinal axis 3, the compensation members 28 have a compensation member length $L_{AE}$ which, according to the embodiment shown, corresponds to more than 50% of a free length $L_f$ of the tappet 4. The greater the length $L_{AE}$, the sturdier the support of the tappet 4 in the housing 2. The free length $L_f$ is understood to mean the length portion of the intermediate web 13 of the central longitudinal axis 3, which length portion is axially bounded by the fastening member 10 on the one hand and the friction lining recess 14 on the other hand. Along the free length $L_f$ no, in particular no further, functional component of the damper 1 is arranged. A functional component is, for example, the friction lining recess 14.

The compensation members 28 are oriented transversely and in particular perpendicularly to a center plane 29 that is defined by the tappet 4, in particular the intermediate web 13. The center plane 29 contains the central longitudinal axis 3.

The compensation members 28 are in particular integrally molded onto the tappet 4, in particular by plastic injection molding. The compensation members 28 serve to support the tappet 4 in the housing 2, in particular against the intermediate channel walls 25 arranged in an opposite position or the friction inserts 26 attached thereto.

The compensation members 28 provide stable support for the tappet 4 against the opposite intermediate channel walls 25. Any play between the tappet 4 and the housing 2, in particular due to manufacturing tolerances, can be compensated for.

The compensation members 28 each rest with a contact surface 30 against the intermediate channel wall 25 or the friction insert 26. It is possible to implement the compensation members 28 using a separate, in particular soft, material, in particular a soft plastic, in particular in the region of the contact surfaces 30, in order to improve the compensation effect and in particular a resilient effect of the compensation members 28.

Due to the fact that the compensation members 28 are designed to be wave-shaped, there is a support width Bs at which the compensation members 28 are supported against the opposite housing walls 25. The support width Bs corresponds to a vertical projection of the contact surfaces 30 onto one of the housing walls 25.

The compensation members 28 allow a comparatively large support surface Bs and thus a reduced surface pressure onto the contact surfaces 30. The wear of the compensation members 28 and the contact surfaces 30 is thus reduced.

By means of the compensation members 28, the tappet 4 is arranged in the housing without play. An undesired displacement of the tappet 4 in a direction perpendicular to the center plane 29 or a tilting of the tappet about a transverse axis 31 that is oriented perpendicular to the central longitudinal axis 3 and is located in the center plane 29 is thus prevented.

The compensation members 28 are arranged in the housing 2 with a preload which acts perpendicularly to the center plane 29. The preload results from the fact that the compensation members 28 have a free height Hf in the region of the intermediate web 13, which free height Hf is in particular greater than a vertical distance $A_s$ of the opposite intermediate channel walls 25 or of the friction inserts 26. This means that the compensation members 28 are compressed in a direction perpendicular to the center plane 29 when the tappet 4 is inserted into the housing 2.

In particular, the tappet 4 is arranged symmetrically with respect to the center plane 29 in the housing 2.

It is advantageous if the tappet 4 is axially guided with the two side webs 11, 12 parallel to the central longitudinal axis 3 in the housing 2, in particular in the longitudinal channels 22. This axial guidance is favored in particular by the fact that the side webs 11, 12 rest with guiding surfaces 32 that face each other on portions 33 of the friction inserts 26 that are bent over in an L-shape. This additionally reduces the noise generation.

In the following, the functional principle of the friction damper is described. The desired frictional force can be set, for example, by selecting the thickness $D_R$ of the friction lining 17. In particular, the friction lining 17 can have a thickness $D_R$ that is greater than the width $B_Z$ of the intermediate channel 23. The friction lining 17 is thus preloaded and rests against the friction surfaces 35 of the friction inserts 26. In the direction 8 and perpendicularly thereto in the plane formed by the intermediate web 13, the friction lining 17 is held by the end sides 16 and longitudinal sides 15. One friction lining 17 is in direct contact with the opposite friction surfaces 35. Thus, exactly only one friction lining 17 is required to act in a frictional manner on two opposite friction surfaces 35. Due to the shape of the recess 14 and the circumferential design of the friction lining 17, the damping characteristics of the damper 1 can be adjusted freely to a large extent.

If the tappet 4 is pushed in along the direction 8, the friction lining 17 is initially partially upset due to the static frictional forces between the friction surfaces 20 and the friction surfaces 35, whereby a slight freewheeling effect is achieved. This is followed by an increasing build-up of the sliding frictional force. The same applies to the subsequent withdrawal of the tappet 4 from the housing 2 against the direction 8. If the length $L_R$ of the friction lining 17 in the axial direction is smaller than the axial length $L_A$ of the recess 14, the friction lining 17 is more strongly upset when the tappet 3 is pushed in or pulled out. Thus, a more pronounced freewheeling effect occurs. If the length $L_R$ of the friction lining 17 is greater than the length $L_A$ of the recess 14, i.e. the friction lining 17 is axially preloaded in the recess 14, there is less or no freewheeling effect. The build-up of frictional force is therefore more abrupt. An advantage of the design is that its characteristics can be influenced, i.e. freewheeling or a soft build-up of frictional force, for example. Corresponding characteristics have a positive effect on the operating properties of the washing machine. For example, the floor forces are reduced and the acoustics are improved.

An additional improvement of the operating properties and thus a reduced noise development results from the compensation members 28, which compensate for the play between the housing walls 25 and the surfaces of the intermediate web 13 at the tappet 4. Rattling as a result of the tappet 4 moving in a direction that is perpendicular to the center plane 29 or tilting about the transverse axis 31 is prevented.

Figure 5:
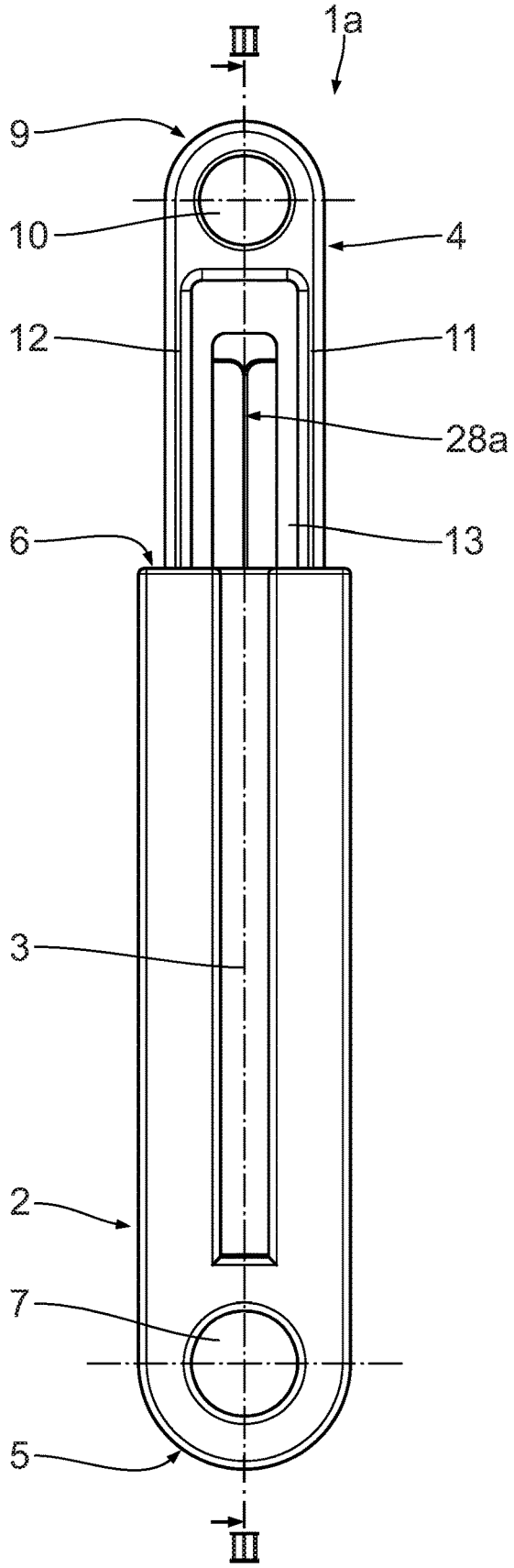
FIG. 5 to 7 shows illustrations, corresponding to FIG. 2 to 4, of a damper according to a second embodiment, having lamellae that are oriented linearly and parallel to the central-longitudinal axis.
Figure 6:
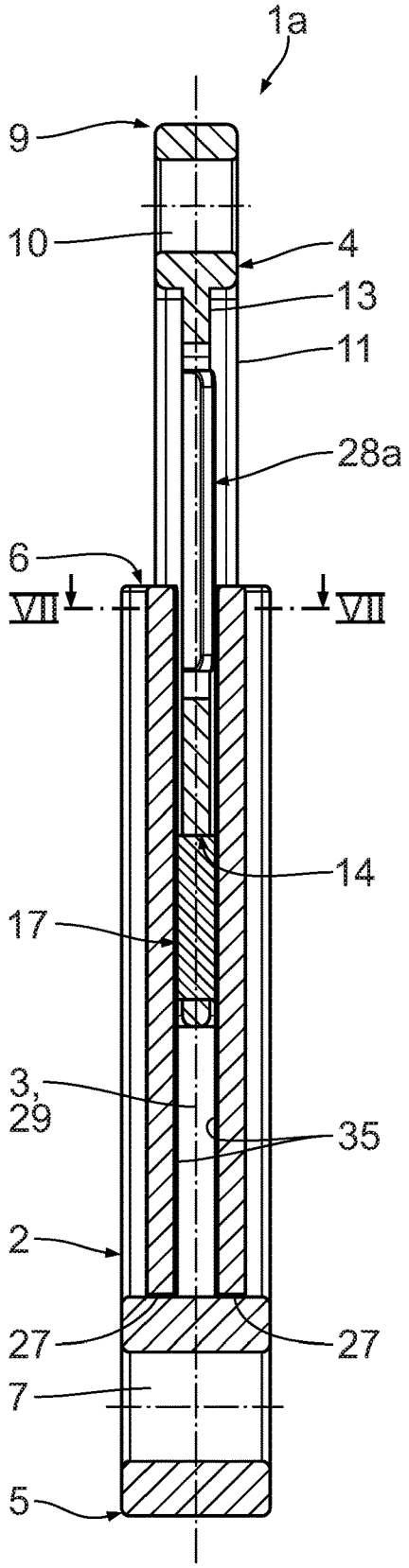
Figure 7:
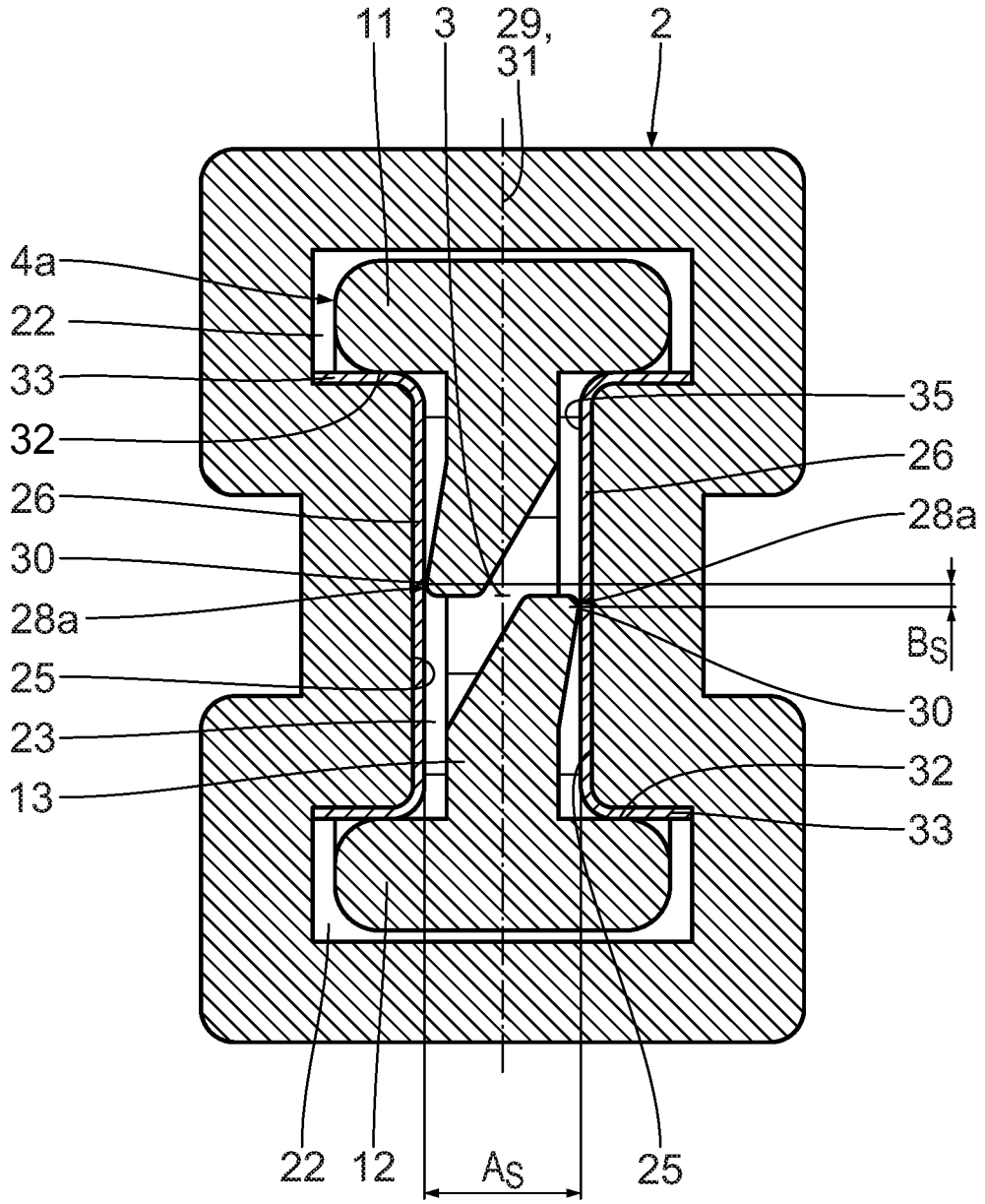

In the following, a second embodiment of the invention is described with reference to FIGS. 5 to 7. Identical parts are given the same reference signs as in the first embodiment, the description of which is hereby referred to. Structurally different but functionally similar parts are given the same reference signs with a trailing letter a.

In the case of the damper 1*a*, the compensation members 28*a* are each oriented parallel to the central longitudinal axis 3. The production of the damper 1*a* with linear lamella is simplified.

The compensation members 28*a* have a reduced support width Bs. The integral contact surface 30 with which the tappet 4*a* rests against the housing 2 is reduced. This reduces the frictional influence of the tappet 4*a* compared to the frictional influence of the friction lining 17. The adjustment of the frictional force, in particular the frictional effect of the friction damper 1*a*, is thereby improved. The frictional effect can be influenced in a more targeted and immediate manner.

Figure 8:
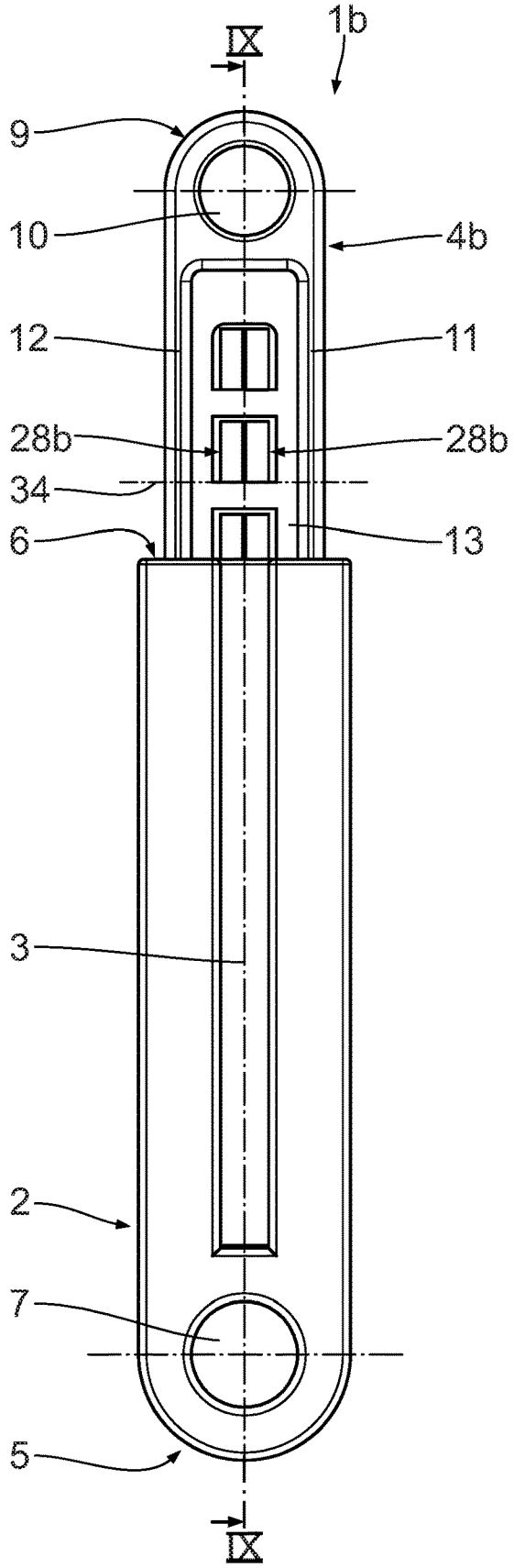
FIG. 8 to 10 shows illustrations, corresponding to FIG. 2 to 4, of a damper according to a third embodiment, having multiple transverse lamellae.
Figure 9:
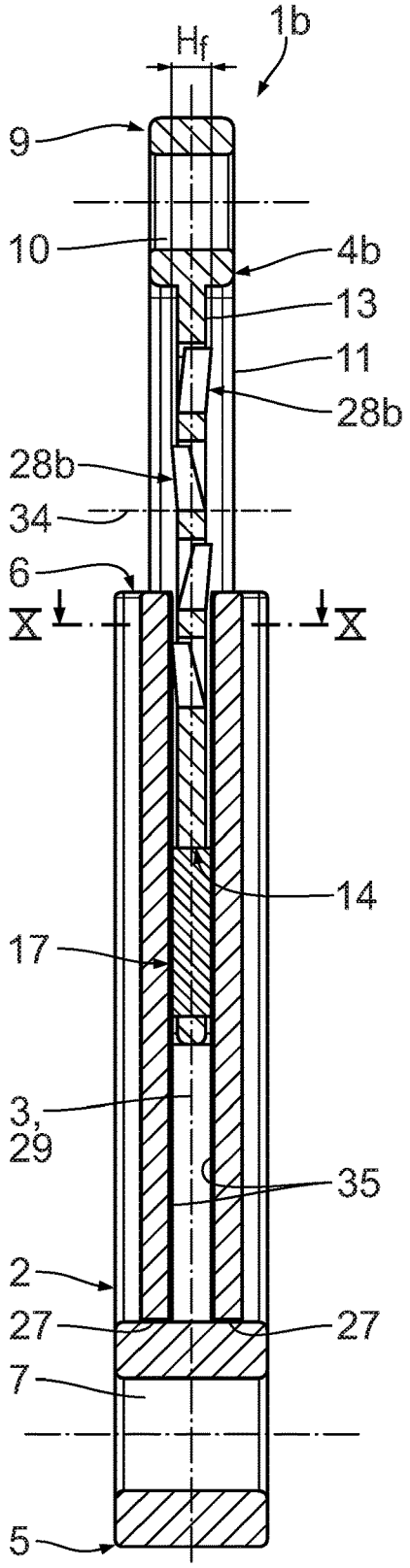
Figure 10:
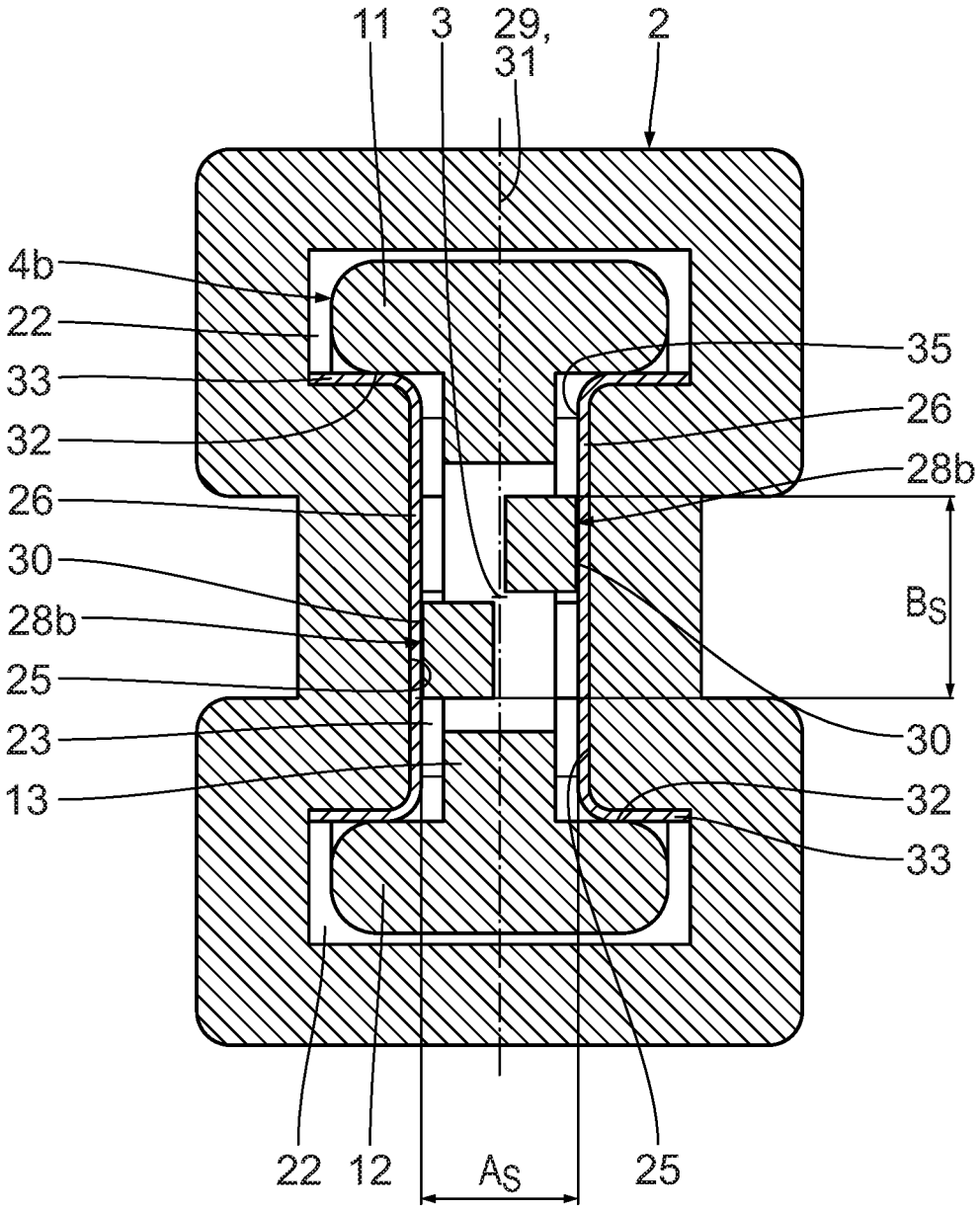

In the following, a third embodiment of the invention is described with reference to FIGS. 8 to 10. Identical parts are given the same reference signs as in the first two embodiments, the description of which is hereby referred to. Structurally different but functionally similar parts are given the same reference signs with a trailing letter b.

The damper 1*b* has a plurality of compensation members 28*b* that are spaced apart along the central longitudinal axis. The compensation members 28*b* also extend on both sides perpendicular to the center plane 29. The compensation members 28*b* are integrally formed on the tappet 4*b*, in particular in the intermediate web 13, and can be pivoted about a pivot axis 34. The pivot axis 34 is in particular parallel to the transverse axis 31.

According to the shown embodiment, four compensation members 28*b* are formed in series on the tappet 4*b* along the central longitudinal axis 3. Due to the separate design of the individual compensation members 28*b*, both the support width Bs and the free height Hf can be adapted and adjusted more flexibly.

It is understood that more or less than four compensation members 28*b* can be arranged along the central longitudinal axis 3. It is advantageous if the group of compensation members 28*b* extends over the advantageous length $L_{AE}$, which is at least 50% of the free length $L_f$.

Figure 11:
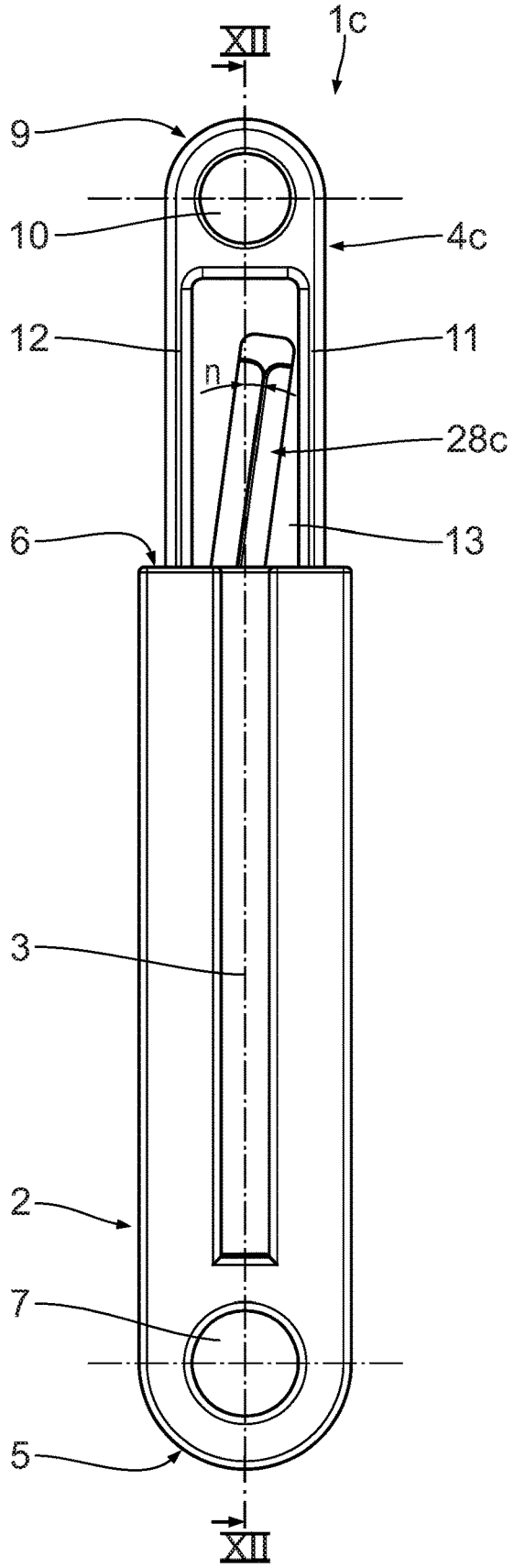
FIG. 11 to 13 shows illustrations, corresponding to FIG. 2 to 4, of a damper according to a fourth embodiment, having linear lamellae which are oriented transversely to the central longitudinal axis.
Figure 12:
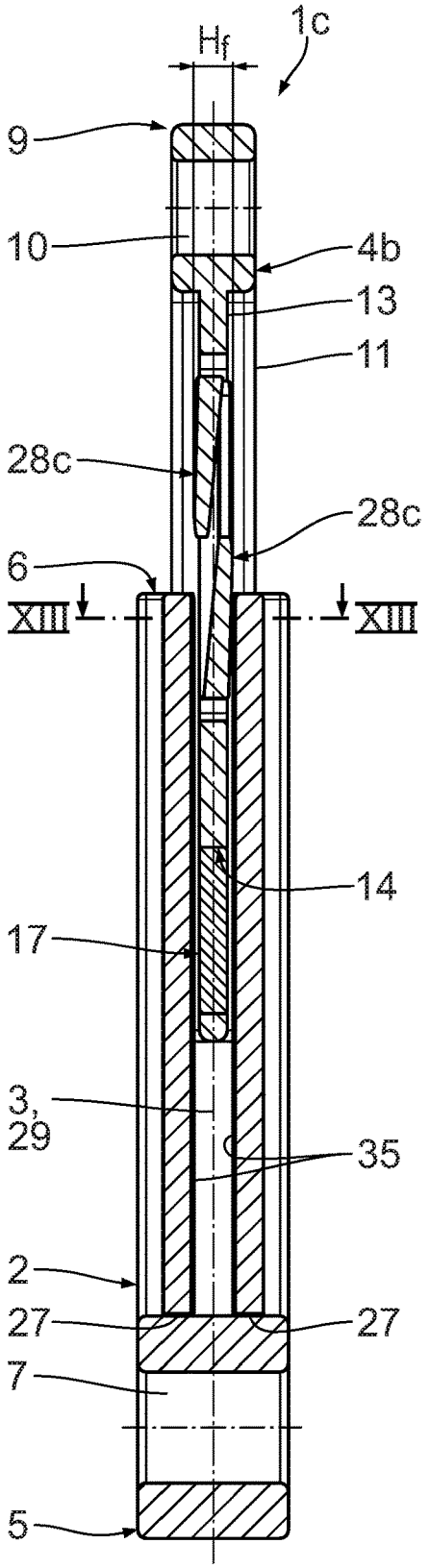
Figure 13:
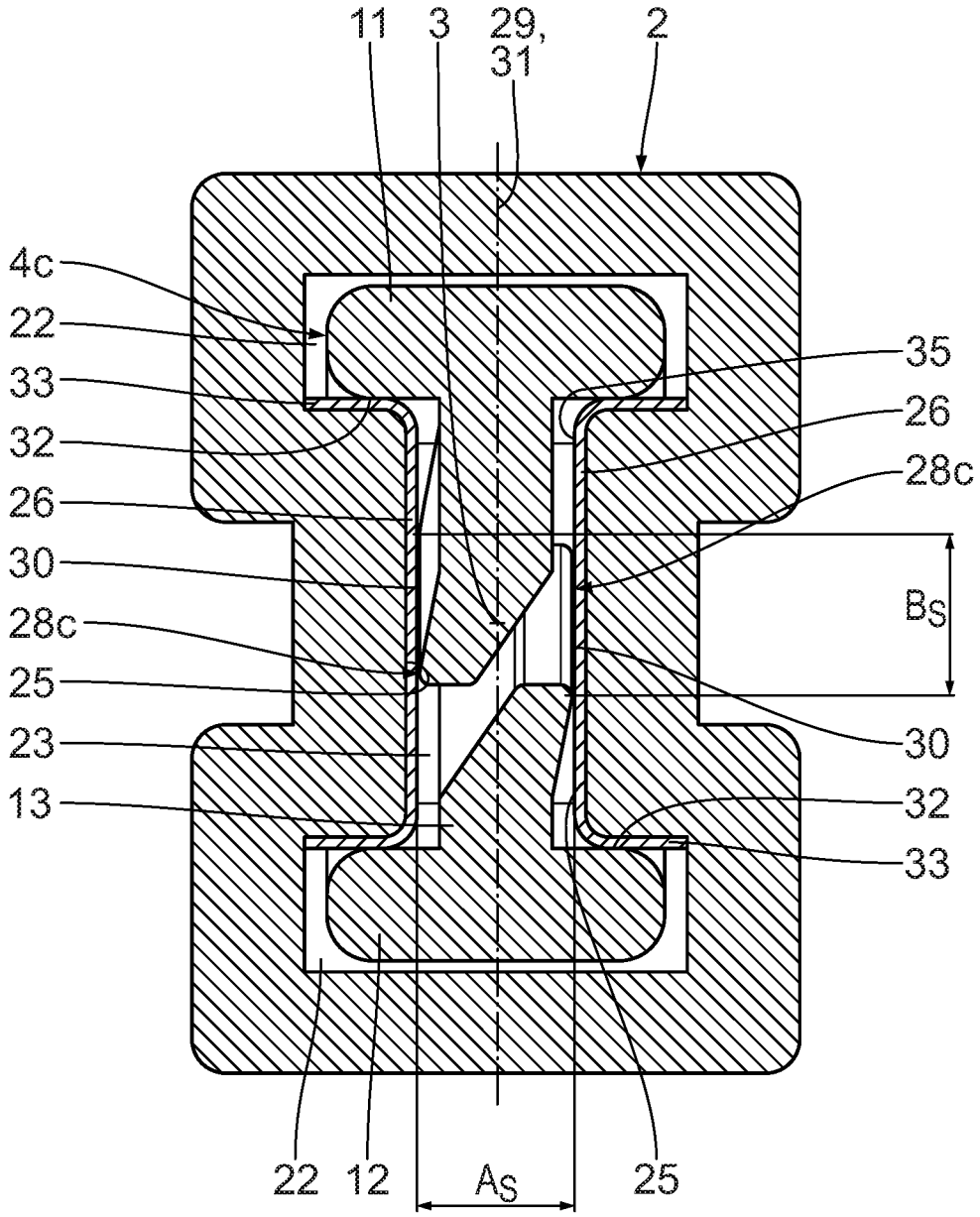

In the following, a fourth embodiment of the invention is described with reference to FIGS. 11 to 13. Identical parts are given the same reference signs as in the previous embodiments, the description of which is hereby referred to. Structurally different but functionally similar parts are given the same reference signs with a trailing letter c.

The compensation members 28*c* are designed as linear lamellae, wherein the longitudinal axes of the compensation members 28*c* are oriented transversely at an angle of inclination n with respect to the central longitudinal axis 3. The compensation members 28*c* also extend on both sides of the tappet 4*c* perpendicular to the center plane 29.

The production, in particular the manufacturing, of the slanted lamella 28*c* is non-complex corresponding to the linear lamella of the second embodiment. The slanted lamella 28*c* has an increased support width Bs, i.e. it is designed to be low-wear.

Figure 14:
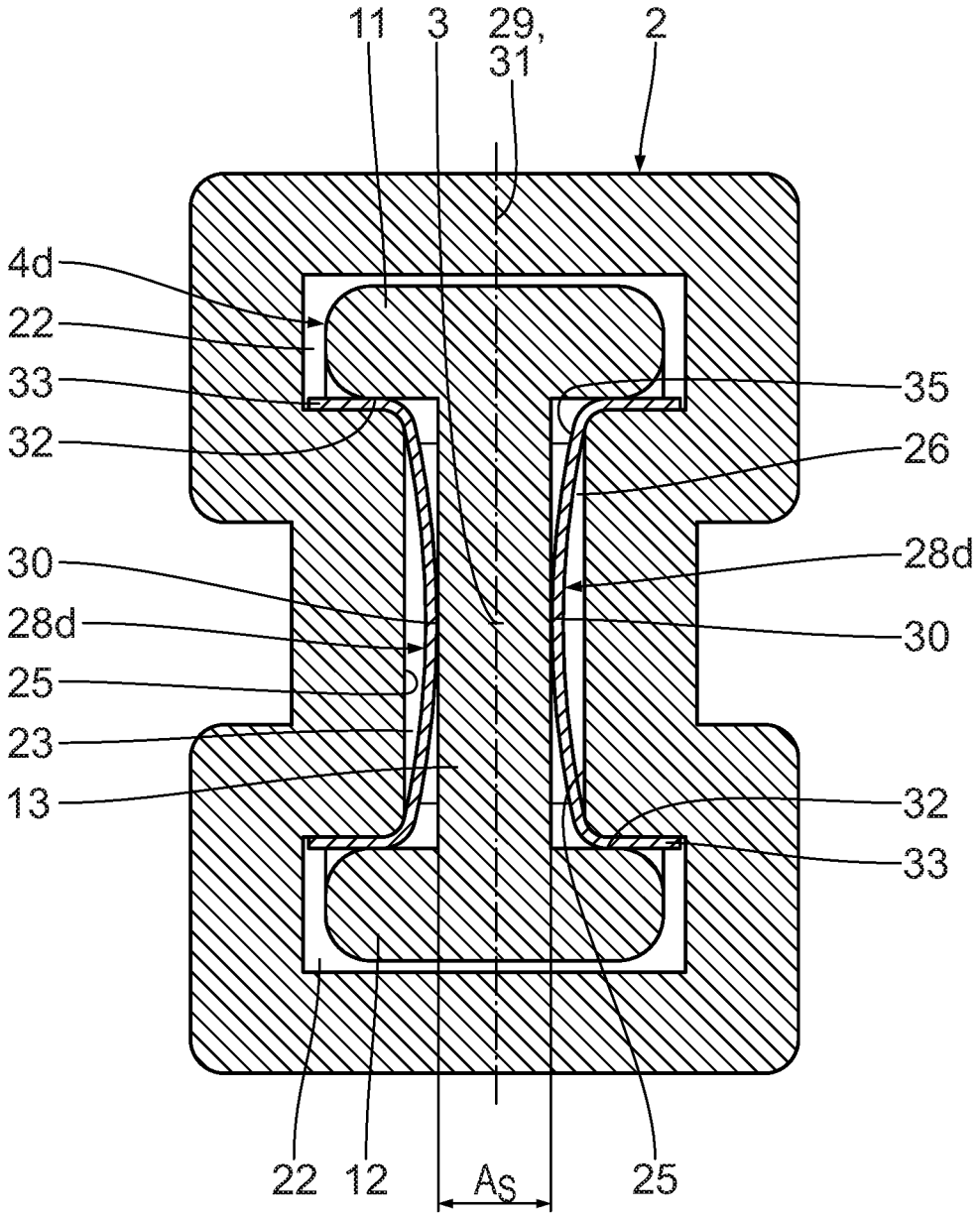
FIG. 14 shows a sectional view corresponding to FIG. 4 of a damper according to a fifth embodiment including surface-type spring members as compensation members on the housing.

In the following, a fifth embodiment of the invention is described with reference to FIG. 14. Identical parts are given the same reference signs as in the previous embodiment examples, the description of which is hereby referred to. Structurally different but functionally similar parts are given the same reference signs with a trailing letter d.

In the case of the damper 1*d*, the compensation members 28*d* are arranged at the housing 2. The compensation members 28*d* are in particular formed as a special design of the friction inserts 26.

Unlike in the previous embodiments, the friction inserts 26 do not run parallel to the intermediate channel walls 25 of the housing 2 in the region facing the intermediate channel 23. The compensation members 28*d* are designed as bent sheet metal portions so that they rest against the tappet 4*d* to compensate for the play between the tappet 4*d* and the housing 2.

The design, in particular the manufacture, of the tappet 4*d* is simplified. In particular, the tappet 4*d* is designed without compensation members. Unwanted contamination, in particular in gaps of the tappet 4, for example by lint, is avoided. Gaps and/or slots in which lint can collect are not provided. The design of the damper 1*d* is robust and non-complex.

The compensation members 28*d* extend along the central longitudinal axis 3 along the compensation member length $L_{AE}$.

According to an embodiment not shown, it is also possible to provide at least one compensation member at the housing 2 and at least one further compensation member at the tappet 4.

What is claimed is:

1. A damper, comprising a. a housing having a central longitudinal axis and at least partially enclosing a housing inner space by housing walls, b. a tappet which can be displaced in the housing along the central longitudinal axis and is guided out of the housing, wherein the tappet has at least one friction lining recess, c. at least one friction lining being arranged in the at least one friction lining recess and rests in a frictional manner against at least one housing wall and/or against a friction insert, d. fastening members which are fastened to free ends of the housing and the tappet, and e. at least one compensation member for compensating a play between the housing walls and the tappet.

2. A damper, comprising a. a housing having a central longitudinal axis and at least partially enclosing a housing inner space by housing walls, b. a tappet which can be displaced in the housing along the central longitudinal axis and is guided out of the housing, c. fastening members which are fastened to free ends of the housing and the tappet, d. at least one compensation member for compensating a play between the housing walls and the tappet, wherein the at least one compensation member is integrally formed on the tappet, which is manufactured in one piece from plastic material.

3. The damper according to claim 1, wherein the at least one compensation member is arranged on the housing.

4. The damper according to claim 3, wherein the at least one compensation member is fastened to the housing.

5. The damper according to claim 3, wherein the at least one compensation member is integrally formed on the housing.

6. The damper according to claim 1, wherein the at least one compensation member has a compensation member length which extends along the central longitudinal axis.

7. The damper according to claim 1, comprising two compensation members.

8. The damper according to claim 7, wherein the two compensation members are oriented in opposite directions with respect to a center plane of the tappet.

9. The damper according to claim 1, wherein the at least one compensation member holds the tappet in the housing.

10. A damper, comprising a. a housing having a central longitudinal axis and at least partially enclosing a housing inner space by housing walls, b. a tappet which can be displaced in the housing along the central longitudinal axis and is guided out of the housing, c. fastening members which are fastened to free ends of the housing and the tappet, d. at least one compensation member for compensating a play between the housing walls and the tappet, wherein the at least one compensation member is configured as a lamella, wherein the lamella at least one of extends at least in portions transversely to the central longitudinal axis and is oriented obliquely, wherein the lamella comprises a sinusoidal configuration.

11. The damper according to claim 1, wherein at least one of the housing and the tappet is double-T-shaped in cross-section.

12. The damper according to claim 11, wherein at least one of the housing and the tappet is perpendicular to the central longitudinal axis.

13. The damper according to claim 1, wherein the tappet has an intermediate web defining a center plane.

14. The damper according to claim 13, wherein the center plane comprises the central longitudinal axis.

15. The damper according to claim 1, wherein the at least one friction lining recess completely penetrates the tappet.

16. The damper according to claim 1, wherein the at least one friction lining recess has one of a rectangular and diamond-shaped form.

17. The damper according to claim 1, wherein the friction lining recess is bounded by end sides located at the axial ends and longitudinal sides connecting the latter.

18. The damper according to claim 17, wherein at least one end side is configured to be serrated.

19. The damper according to claim 1, wherein the shape of the friction lining is adapted to the shape of a friction lining recess.

20. The damper according to claim 1, wherein the friction lining is configured to be serrated on at least one end side.

21. The damper according to claim 1, wherein the housing has a housing body.

22. The damper according to claim 21, wherein the housing body is made in one piece.

23. The damper according to claim 1, wherein at least one friction insert is arranged on the inside of the housing.

* * * * *